US005678764A

United States Patent [19]

Kukesh

[11] Patent Number: 5,678,764

[45] Date of Patent: Oct. 21, 1997

[54] INTERNAL MIX SPRAYING SYSTEM

[75] Inventor: Timothy S. Kukesh, Indianapolis, Ind.

[73] Assignee: Glas-Craft, Inc., Indianapolis, Ind.

[21] Appl. No.: 395,462

[22] Filed: Feb. 28, 1995

[51] Int. Cl.[6] ..... B05B 7/10

[52] U.S. Cl. ..... 239/399; 239/432

[58] Field of Search ..... 239/304, 343, 239/399, 402, 403, 432, 527

[56] References Cited

U.S. PATENT DOCUMENTS

| | | | |
|---|---|---|---|
| 3,073,533 | 1/1963 | Weinbrenner et al. | 239/399 |
| 3,708,123 | 1/1973 | Krueger | 239/527 X |
| 4,061,248 | 12/1977 | Arena | 239/432 X |
| 4,474,333 | 10/1984 | Müller | 239/462 X |
| 4,760,956 | 8/1988 | Mansfield | 239/432 X |
| 5,080,283 | 1/1992 | Kukesh et al. | 239/9 |

*Primary Examiner*—Andres Kashnikow
*Assistant Examiner*—Steven J. Ganey
*Attorney, Agent, or Firm*—Brinks Hofer Gilson & Lione

[57] ABSTRACT

In the method and apparatus of the invention, plural materials, such as a liquid resin and curing agent, are delivered to a dispenser body including a mixing cavity and a mixing element carried in the mixing cavity of the body and carrying a dispenser outlet. The mixing element sealingly engages the mixing cavity and forms, within the mixing cavity, a central chamber into which the plural materials are delivered. The mixing element includes a first conduit extending longitudinally between a forwardmost opening and the central portion of the mixing element, and further includes a second conduit extending transversely between a sidewall opening to the central chamber and the first conduit and containing a static mixing insert. Plural materials delivered to the dispenser body are mixed in transit through the mixing cavity, the transverse second conduit and static mixer, and the first conduit and dispensed through the dispenser outlet.

8 Claims, 3 Drawing Sheets

INTERNAL MIX SPRAYING SYSTEM

The present invention relates to a method and apparatus for internally mixing and dispensing plural materials, and particularly to an improved method and apparatus for the internal mixing and spraying of plural component materials. More particularly, the invention relates to mixing pieces having a plurality of internal channels and to mixing pieces with mixing inserts disposed therein.

BACKGROUND OF THE INVENTION

Multi-component application systems have been used, for example, in manufacturing plastic articles by applying resinous materials to a mold or preform for an article, or to pre-arranged fiber reinforcing materials, or with fiber reinforcing materials as they are being applied.

In multi-component application systems, a liquid resin and a curing agent for the resin are mixed and dispensed, into or onto articles or substrates where the curing agent and resin react and harden. In spraying applications, the resin and curing agent components are mixed together, either externally or internally of the apparatus, and the mixture is directed onto a substrate as a plural component spray. For example, in manufacturing articles with polyester resin, a catalyzing agent for the polyester resin is mixed with the resin, and the resin-catalyst mixture is then applied to the substrate. In internal mix systems, the resin and catalyst are mixed within the spraying apparatus, and the mixture is then atomized by a spray nozzle and directed onto the substrate. Complete and thorough mixing of the resin and catalyst is vital to avoid non-uniform hardening of the resin on the substrate and other undesirable results.

Furthermore, mixed resin and catalyst must be removed from an internal mix apparatus to avoid blockage of the apparatus by cured resin, and such apparatus are generally flushed with flows of compressed air and/or solvent to prevent such blockage.

In internal-mix systems, such as that disclosed in U.S. Pat. No. 4,967,956 to Mansfield and in U.S. Pat. No. 5,080,283 to Kukesh, et al., an axially extending spiral mixer is positioned in the forward gun body portion to mix the plural components together. The separate flows of the plural components come together in the spray gun body and are directed into a central channel in the forward gun body portion. A mixing insert, such as a commercially available spiral mixer, is positioned in the central channel and forces the flows together and along a helical path. In the process of following the helical path, the separate flows are tucked into each other to mix the flows together. However, such commercially available spiral mixers are not always satisfactory because the mixing inserts do not completely mix the plural components together. It is believed that the mixing inserts fail to break up completely the laminar flow of the separate components, causing the flows to move along side-by-side rather than mixing together. Some manufacturers have attempted to overcome the problem of incomplete mixing by using longer mixing inserts, increasing the length of the mixing passageway, and sometimes the length of the forward gun body portion in order to house the longer inserts. Unfortunately, such modifications are inconsistent with the desire for small, light-weight and inexpensive apparatus and inconsistent with the need for rapid and effective flushing of mixed components from the apparatus. Furthermore, such modifications did not appreciably improve the plural component mixing. Thus, a need continues to exist for a method and apparatus that improves plural component mixing without the adverse affects associated with earlier attempts to improve mixing.

SUMMARY OF THE INVENTION

In the method and apparatus of the invention, plural materials, such as a liquid resin and curing agent, are delivered to a dispenser body including a mixing cavity and a mixing element carried in the mixing cavity of the body and carrying a dispenser outlet. The mixing element sealingly engages the mixing cavity and forms, within the mixing cavity, a central chamber into which the plural materials are delivered. The mixing element includes a first conduit extending longitudinally between a forwardmost opening and the central portion of the mixing element, and further includes a second conduit extending transversely between a sidewall opening to the central chamber and the first conduit and containing a static mixing insert. Plural materials delivered to the dispenser body are mixed in transit through the mixing cavity, the transverse second conduit and static mixer, and the first conduit and dispensed through the dispenser outlet. In spraying methods and apparatus, the dispenser body carries, as a dispensing outlet, a spraying means which can be either an airless spray top or an atomizing spray assembly.

The mixing element used in an internal-mix plural component dispensing apparatus of the invention comprises a mixing piece having first and second channels. The first channel extends from a first end along the longitudinal axis of the mixing piece and the second channel extends outwardly from the central channel to an outer sidewall. In preferred embodiments of the invention, the first channel and the second channel are orthogonal to each other and the mixing means includes a mixing insert disposed in the second channel.

The invention also includes a method of mixing plural component materials together internally of a dispensing apparatus. The method comprises the steps of directing separate flows of plural components to a dispensing apparatus, combining and mixing the separate flows in a chamber formed in the apparatus, directing the combined and mixed flows into a transversely directed conduit, preferably including a static mixer, and changing the direction of the further mixed flows by directing the further mixed flows from the transverse conduit into a longitudinal conduit formed in the mixer.

In preferred methods, the second channel extends along a longitudinal axis of the mixer and the first channel extends radially outwardly from the second channel and the further mixed flows are redirected through an angle of 90°. With the preferred mixing method, the combined and mixed flows are repeatedly divided and tucked into each other by division and direction along a generally helical path, and redirected at a right angle formed in the conduits of the dispensing apparatus. Thus the invention combines a plurality of mixing techniques to achieve uniform mixing of the plural component materials.

By providing first and second orthogonal channels and including a mixing insert, such as a spiral mixer, in one of the channels, and providing plurality of mixing techniques, the present invention provides a novel mixer and substantially improves the mixing of plural component materials in an internal mix dispensing apparatus.

Additional objects, features, and advantages of the invention will become apparent to those skilled in the art upon consideration of the following detailed description of a preferred embodiment exemplifying the best mode of carrying out the invention as presently perceived.

DETAILED DESCRIPTION OF THE DRAWINGS

Although the invention may be incorporated into any internal mix dispensing system, it is illustrated, preferentially, in a spraying system in which the dispensing outlet 18 is a spray nozzle assembly carried at the forward end of the dispenser body 17.

Figure 1:
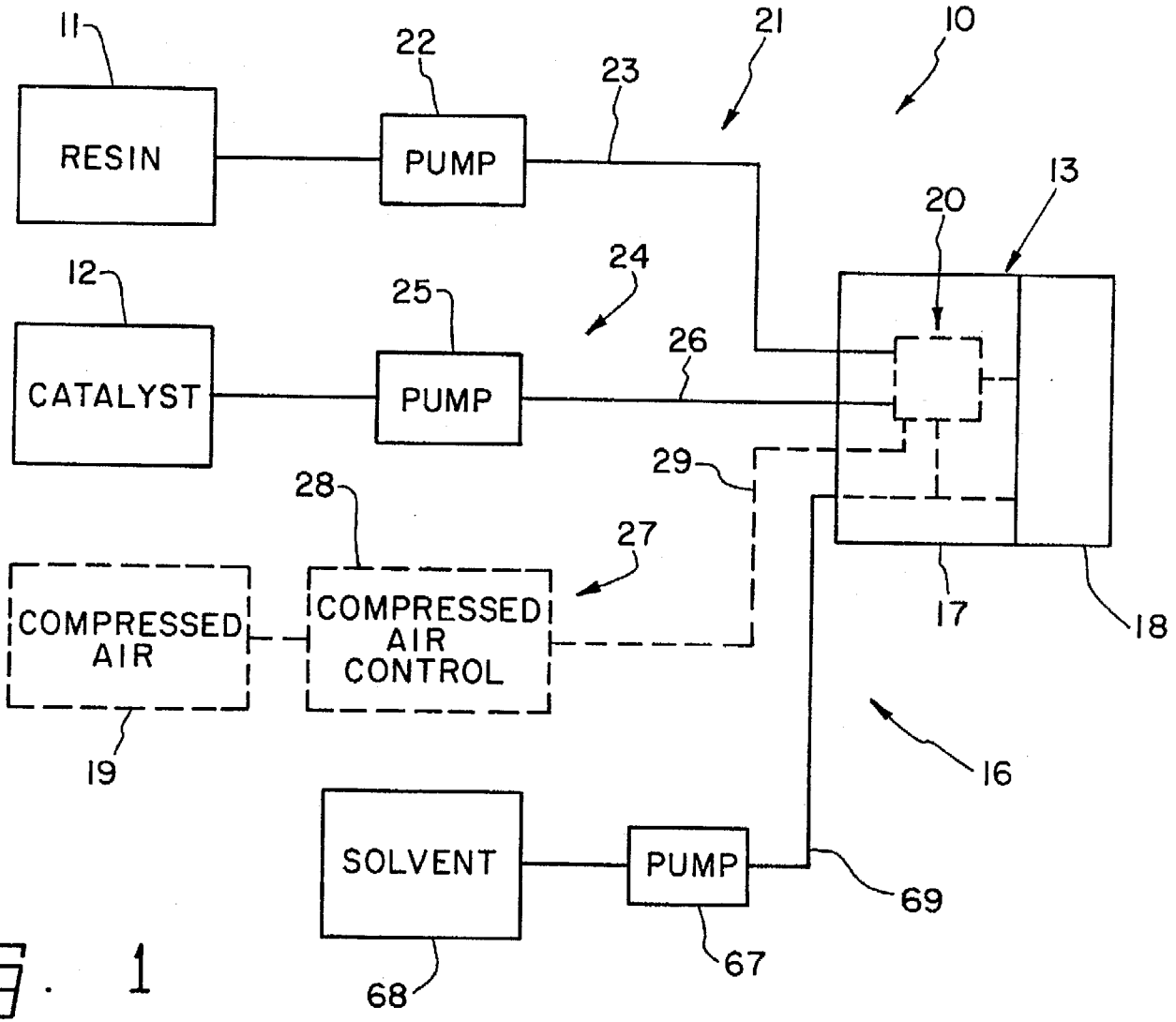
FIG. 1 is a schematic diagram of a system for internally mixing and dispensing plural component material which can incorporate the invention.

FIG. 1 schematically illustrates an exemplary internal mix, airless atomization, plural component spraying system of the invention. The system is generally designated by reference numeral 10 and includes a first source 11 of a first component, e.g., a resinous material; a second source 12 of a second component, e.g., a catalyst for the resinous material; spraying means 13 for mixing the catalyst and resin and for directing the mixture at a substrate (not shown); and delivery means 16 for delivering the resin and catalyst to the spraying means during operation of the system. The system can also include means for cleaning the spraying means 13 of mixed catalyst and resin comprising a source of solvent 68, a solvent pump 67 and a conduit 69 to deliver cleaning solvent to spraying means 13 and mixer 20.

Figure 2:
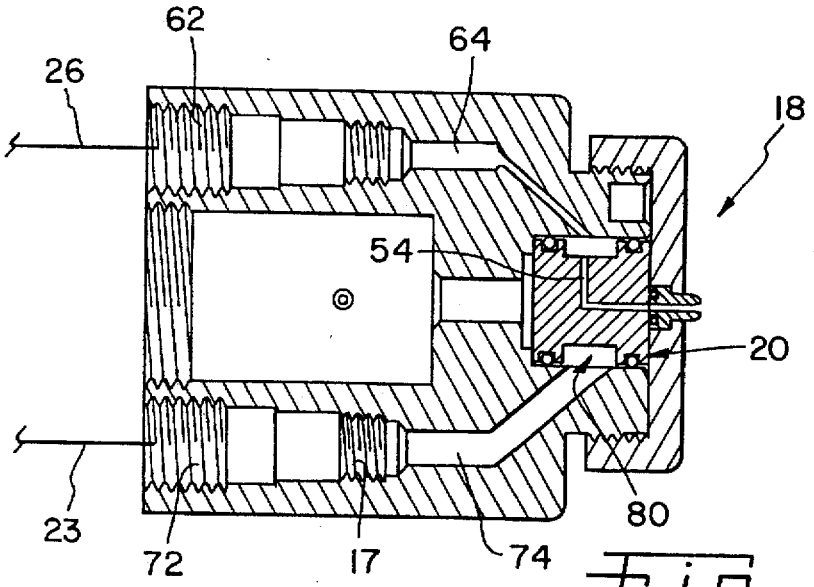
FIG. 2 is a cross-sectional view of a dispenser incorporating the invention.
Figure 6:
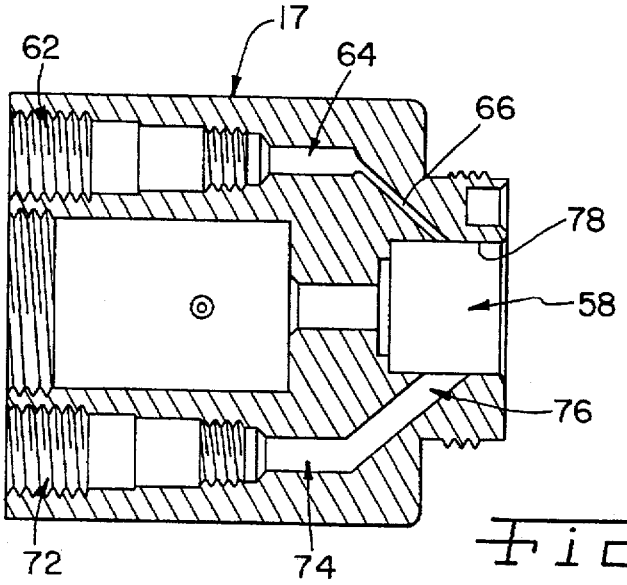
FIG. 6 is a section view of the spray gun of FIG. 5 taken along lines 6—6 in FIG. 5.
Figure 5:
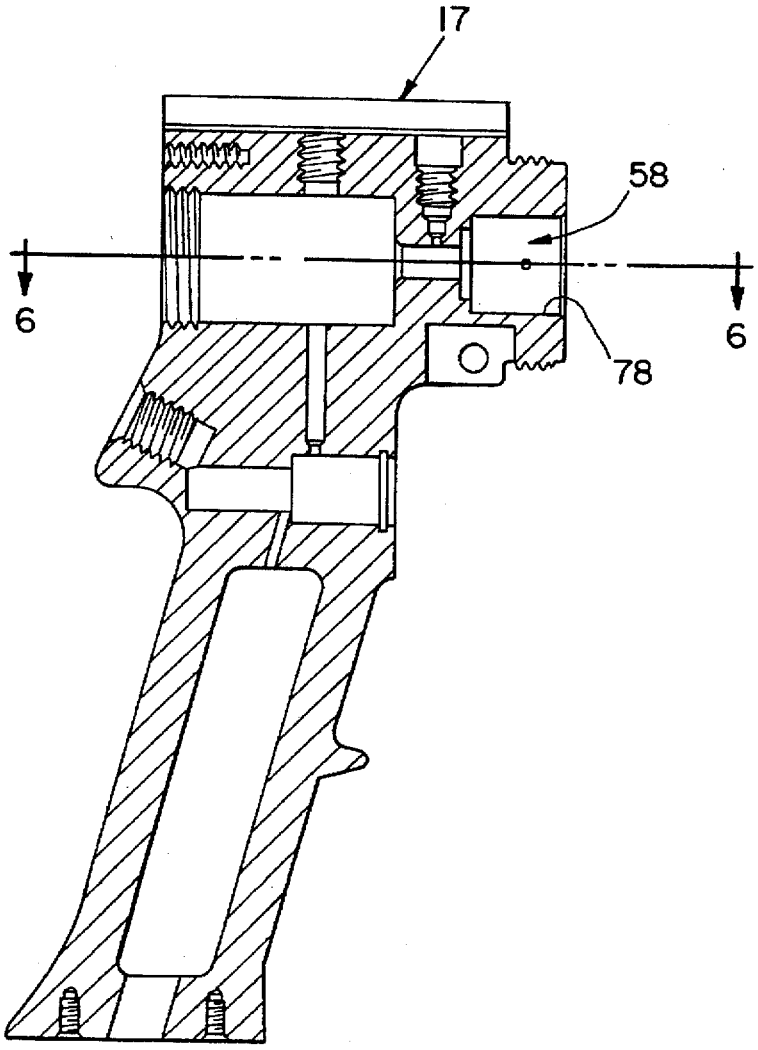
FIG. 5 is a vertical section taken through the body of an internal-mix plural component spray handgun for use with the present invention.

Spraying means 13 is shown in cross-section in FIGS. 2, 5–6 and preferably comprises a hand-held gun which includes a spray gun body 17 with a nozzle assembly 18 at its front. Spray gun body 17 incorporates a mixer 20 to mix the resin and catalyst within spray gun body 17. Nozzle assembly 18 comprises an airless atomization nozzle assembly in which compressed air and liquid under pressure are combined in the spraying of the mixed resin and catalyst. Delivery means 16 includes means 21 for delivering the resin including a resin pump 22 and resin conduit 23 between the source of resin 11 and the spray gun body 17; means 24 for delivering catalyst including a catalyst pump 25 and a catalyst conduit 26 between the source of catalyst 12 and the spray gun body 17.

Where it is desired to use compressed air to assist in the application of the plural component material and cleansing of the dispenser, the system can include means 27 for delivering compressed air including a compressed air control 28 and an air conduit 29 between compressed air source 19 and spray gun body 17, as shown in dashed lines.

As described below, a flow of resin from resin source 11 and a flow of catalyst from catalyst source 12 are delivered to spray gun body 17 where they are mixed by mixer 20 and directed as a mixture of catalyst and resin to nozzle assembly 18 which creates a spray of resin-catalyst particles for direction to a substrate. Nozzle assembly 18 includes an airless spray nozzle to which the mixed resin and catalyst are directed and which preferably forms the mixed resin and catalyst into a plurality of streams as disclosed in U.S. Pat. No. 5,080,283.

Nozzle assembly 18 can also include a plurality of compressed air nozzles to coact with the airless spray nozzle to assist in atomization of the resin-catalyst mixture, particularly the tails of the fan-like resin-catalyst film formed thereby, and to capture the particles of resin and catalyst within the resulting spray pattern, as shown in U.S. Pat. No. 4,967,956.

Thus, mixed resin and catalyst can be applied to the substrate where it solidifies to form an article of manufacture. The substrate can be a mold for an article, such as a boat hull, boat part, shower stall, or the like. Any one of the number of resins and catalysts can be used in systems of this invention.

System 10 may, of course, include a chopper carried by spraying means 13 to dispense strands of fiberglass or the like into the spray pattern of plural component material to reinforce the article of manufacture formed on substrate. Although FIG. 2 illustrates a conventional airless nozzle as the dispenser, this nozzle assembly 18 may be as disclosed in U.S. Pat. No. 4,967,956.

Figure 3:
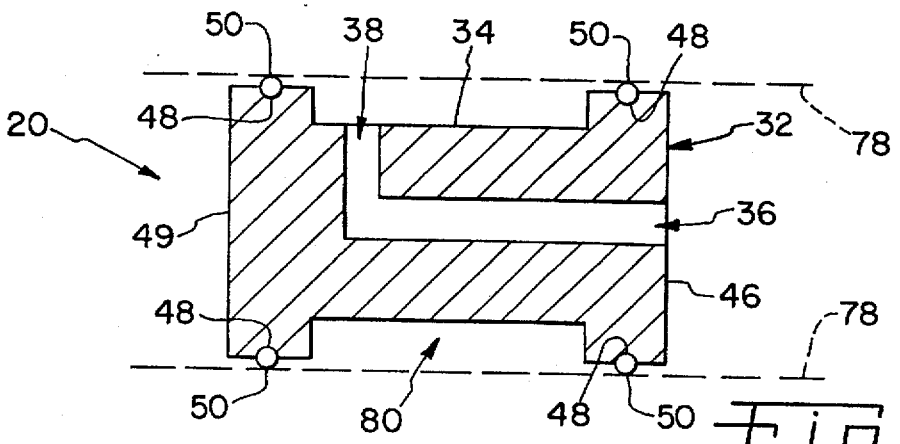
FIG. 3 is a section view of a mixer element of the invention taken along the longitudinal axis of the mixer.

In the present invention, a mixer element 20 includes a dumbbell-shaped mixing piece 32 having a reduced diameter central portion 34, including two internal conduits 36, 38, and a pair of sealing end portions 44, 46. As shown in FIGS. 2–3, a first conduit 36 extends longitudinally in the mixing piece 32, preferably along its longitudinal axis, and a second conduit 38 extends transversely from the first conduit 36 to the outside of the central portion 34. Preferably, the first and second conduits 36, 38 are orthogonal to each other. However, the first and second channels can be joined at an angle other than a right angle without departing from the scope of the invention. It is also possible to use a plurality of longitudinal and radial channels without departing from the scope of the invention. The sealing end portions 44, 46 include perimetral grooves 48 for receiving o-rings 50. The mixer element 20 is disposed in a central cavity 58 of a spray gun body 17, as shown in FIG. 2.

Figure 4:
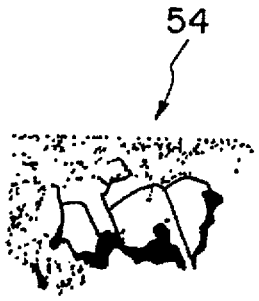
FIG. 4 is an illustration of one form of static mixing insert usable with the present invention.

A static mixing insert 54, such as illustrated in FIG. 4, is disposed in channel 38. Mixing inserts 54, which are commercially available, are generally known as spiral mixers within the industry and come in a variety of lengths and diameters.

A conventional internal-mix dispensing apparatus for use with the invention is disclosed in U.S. Pat. No. 5,080,283 to Kukesh, et al., the disclosure of which is incorporated herein by reference. As illustrated in FIGS. 5–6, a spray gun body 17 includes a valve housing 62 (FIG. 6) formed in the back of the gun body 17 for receiving a resin control valve (not shown). The valve housing 62 opens into a passage 64 which extends forwardly into the gun body 17. The passage 64 terminates at an angled passage 66 which extends from the passage 64 to the central mixer-receiving cavity 58 formed in the gun body 17.

The spray gun body 17 also includes a valve housing 72 (FIG. 6) formed in the back of the gun body 17 for receiving a catalyst control valve (not shown). The valve housing 72 opens into a passage 74 which extends forwardly into the gun body 17. The passage 74 terminates at an angled passage 76 which extends from the passage 74 to the central mixer-receiving cavity 58.

The mixer element 20 is positioned in the central cavity 58 so as to permit sealing engagement between the o-rings 50 and the sidewall 78 of the central cavity 58. When positioned in the cavity 58, the cylindrical portion 34 of the mixer element 20 cooperates with the o-rings 50 and the sidewall 78 to provide an annular chamber 80 where the resin and catalyst can come together before entering the mixer element 20.

In operation, an operator pulls a trigger (not shown) on the spray gun body 17 which opens the resin and catalyst control valves (not shown) to port resin and catalyst to the annular chamber 80. The second channel 38 provides the only outlet from the annular chamber 80, so the joined flows of resin and catalyst enter the second channel 38. Pressure from the incoming resin and catalyst push the joined flows through the second channel 38 while the mixing insert 54 imparts a helical motion to the flows, causing the flows of resin and catalyst to tuck into each other while following a helical path.

Unfortunately, the mixing action caused by the mixing insert 54 is not complete, presumably due to laminar flow conditions in the second channel 38 around the mixing insert 54. However, when the flows complete their complete their transit through the second channel 38, the present invention redirects them through a preferred angle of 90° to transit through the first channel 36 toward a liquid nozzle (not shown), such as described in the Kukesh '283 patent. The act of turning the flows through 90° induces a different mixing action where the flows fold into each other, thereby breaking up the laminar flow conditions, and completely mixing the plural component materials. Advantageously, the combination of the two different types of mixing action causes the once separate flows of resin and catalyst to be completely mixed, thereby ensuring proper proportions of resin and catalyst to maximize product quality.

Although the invention has been described in detail with reference to a certain preferred embodiment, variations and modifications exist within the scope and spirit of the invention as described and defined in the following claims.

I claim:

1. In an internal-mix plural component dispensing apparatus comprising a sprayer body having a cylindrical chamber at its forward end and a plurality of internal channels for directing plural component materials to the cylindrical chamber, said sprayer body and cylindrical chamber being connectable with a sprayer tip, the improvement comprising:

a mixer element for disposition in the cylindrical chamber of the sprayer body between the internal channels and the sprayer tip for mixing the plural component materials together, the mixer element including at least one portion sealingly engaging the forward end of the sprayer body in the cylindrical chamber and forming an outer chamber in communication with said internal channels, said mixer element further comprising a first channel extending along a longitudinal axis of the mixer element and opening to direct mixed plural component materials toward the sprayer tip and a second channel extending outwardly from the first channel and opening for receiving the plural component materials from the outer chamber and directing the plural component materials to the first channel, said mixer element further including mixing means disposed in one of the first and second channels for mixing the plural component materials.

2. The improvement of claim 1 wherein the first channel is substantially orthogonal to the second channel.

3. The improvement of claim 2 wherein the mixing means includes a mixing insert disposed in the second channel.

4. A dispensing apparatus for mixing and dispensing plural component materials, comprising a body having a mixing cavity formed by at least one outer wall, said cavity including at least two openings in its central portion, for flows of the plural component materials, a dispenser outlet carried by said body in communication with said mixing cavity, and a mixing element carried in said mixing cavity and sealingly engaging said at least one wall of said mixing cavity forwardly and rearwardly of its central portion, the central portion of said mixing element forming, with said at least one wall of said mixing cavity, a chamber for the flows of said plural materials, said mixing element including a first channel extending longitudinally from its forward end to the central portion of the mixing element, and a second channel in its central portion extending from said chamber into said first channel, said second channel carrying a mixer insert, whereby said plural component materials can be directed through said body into and from said cavity and said first and second channels to said dispenser for dispensing mixed plural components materials.

5. The dispensing apparatus of claim 4 wherein the first channel and the second channel are orthogonal to each other.

6. A dispensing apparatus for mixing and dispensing plural component materials, comprising a body having a mixing cavity formed by at least one outer wall, said cavity including at least two openings in its central portion for flows of the plural component materials, a dispenser outlet carried by said body in communication with said mixing cavity; and a mixing element carried in said mixing cavity and sealingly engaging said at least one outer wall of said mixing cavity forwardly and rearwardly of its central portion, the central portion of said mixing element forming, with said at least one outer wall of said mixing cavity, a chamber for the flows of said plural materials, said mixing element including a first channel extending longitudinally from its forward end to the central portion of the mixing element, and a second channel in its central portion extending from said chamber into said first channel, and a mixer insert.

7. The dispensing apparatus of claim 6 wherein said mixer insert comprises mixing means disposed in one of the first and second channels for mixing the plural component materials together.

8. The dispensing apparatus of claim 6 wherein the mixing element includes a mixing insert disposed in the second channel.

* * * * *